United States Patent [19]

Beckett

[11] 4,264,329

[45] Apr. 28, 1981

[54] TRACING FLOW OF FLUIDS

[75] Inventor: James R. Beckett, Tulsa, Okla.

[73] Assignee: Cities Service Company, Tulsa, Okla.

[21] Appl. No.: 34,081

[22] Filed: Apr. 27, 1979

[51] Int. Cl.[3] ..... G01N 21/00; G01N 31/08; G01N 33/18

[52] U.S. Cl. ..... 23/230 EP; 23/230 M; 23/230 R

[58] Field of Search ..... 23/230 EP, 230 R, 232 C

[56] References Cited

U.S. PATENT DOCUMENTS

| | | | |
|---|---|---|---|
| 3,149,068 | 9/1964 | Biederman et al. | 23/230 R X |
| 3,656,908 | 4/1972 | Noll et al. | 23/230 R |
| 3,856,468 | 12/1974 | Keller | 23/230 EP |

FOREIGN PATENT DOCUMENTS

| | | | |
|---|---|---|---|
| 594807 | 3/1960 | Canada | 23/230 EP |

OTHER PUBLICATIONS

Water Tracing With Soluble Metal Chelates and Neutron Activation Analysis; A Lab. and Field Study, USAEC RLO-1750-81.

CA 90/114361, Anal. Chem. 1979, 6, 4-(Pyridylazo) Resorinol Base Continuous Detection System of Metal Ions.

CA 82/38709U, J. Med. Chem. 1974, #12 pp. 1304-1308, Selective Binding of Metal Ions to Macromolecules using Bifunctional Analogs at EPTA.

CA 68/13223N

CA 68/23720C

CA 83/151737K

CA 76/117348E

CA 76/89783X

CA 90/109556V

CA 189/211426M

*Primary Examiner*—Michael Marcus

*Attorney, Agent, or Firm*—Richard D. Stone

[57] ABSTRACT

A tracer system is disclosed which is especially useful for following fluid flow in underground reservoirs. Metal chelates, preferably derived from EDTA and containing a functional group which reacts with a fluorogenic agent, are used as tracers. Liquid chromatography and fluorescense spectroscopy are used to detect the metal chelates.

11 Claims, No Drawings

TRACING FLOW OF FLUIDS

FIELD OF THE INVENTION

The invention relates to tracing flow of fluids.

The invention is especially useful in tracing fluid flow in underground reservoirs.

There has been interest for many years in tracing the flow of fluids. One of the most important aspects to fluid flow tracing occurs in the production of petroleum. In primary production of oil, oil is recovered from the ground by pumping or under its own pressure. In secondary recovery, water is injected into an oil bearing formation via an injection well. The water maintains pressure in the formation and displaces oil towards the producing well. In tertiary recovery operations, a surface active agent is injected into a formation to more efficiently displace oil towards a producing well. In secondary and tertiary recovery operations, it is important to be able to follow the path of fluid flow from an injection up to a production well. Most reservoirs are not homogenous, but instead contain regions of varied permeability, fractures, and other structural barriers.

The need for an effective tracer system is described by Troutman and Schutz in their paper "Field Applications of Radioactive Tracers in Secondary Recovery", Europe and Oil, June, 1970. They stated that a frequent fluid flow problem in a reservoir is the appearance of an injected fluid at a producing well at a time other than anticipated. When this occurs, it is important to learn the source of the injected fluid being produced. If a tracer is added to each of several injection wells, the presence of these tracers in produced fluids will identify the injection site.

Tracer materials must have several characteristics. They must be relatively safe to handle. Cost must be reasonable. The fluid should be relatively inert in a formation. Finally, the tracer must be easily identified in the produced fluids, preferably both qualitatively and quantitatively.

The use of tracer materials for tracing fluid flow is not new. Many materials have been used as tracers, such as dyes, gases such as helium and carbon dioxide; acids such as picric acid, salicylic acid, ethylene-diaminetetraacetic acid (EDTA), or the salts thereof; ionizable compounds which provide ammonium, boron, chromate, etc., ions and radioactive materials, such as krypton-85.

These materials have not been completely satisfactory. The dyes, radioactive materials, and gases are rarely used because they are expensive or hard to detect. The radioactive materials are very detectable, but are expensive and require special handling.

An early study was reported by Greenkorn, R. A., "Experimental Study of Waterflood Tracers", SPE-169, presented at the meeting of the Society of Petroleum Engineers of AIME in Dallas, 1961. Thirty-five materials were at first considered. Many were quickly eliminated to result in a list of 13 possible candidates. The 13 materials were:

EDTA
Fluorescein
Picric Acid
Salicylic Acid
Ammonium
Borate
Bromide
Dichromate
Iodide
Nitrate
Thiocyanate
Chloride
Tritiated Water The EDTA and salicylic acid were passed over a simulated core and rejected as tracer materials because both were adsorbed by the core.

Fluorescein and thiocyanate give poor results at first because these materials were sensitive to solution pH and exposure to light.

Tritiated water and bromide, chloride, iodide, nitrate and thiocyanate ions were considered suitable water soluble tracers.

Fluorescein was considered satisfactory, but no more than satisfactory.

The remaining materials were unsatisfactory.

A significant step forward in the tracing art was disclosed by Riedel, in U.S. Pat. No. 3,993,131 (U.S. Class 166/252), the teachings of which are incorporated by reference. Riedel disclosed use of stable-free radicals, detectable by electron spin resonance spectroscopy, as tracer materials.

In general terms, metals are much more readily detectable than non-metals, with the exception of the radioactive materials. The absolute limit of detection for many metals is given in the following Table II.

TABLE II

| Technique | Absolute Limit of Detection (ng) |
|---|---|
| Atomic Emission Spark Spectrometry | $10^1$-$10^3$ |
| Atomic Emission Arc Spectrometry | 10-$10^2$ |
| Atomic Emission RF Plasma Spectrometry | $10^{-3}$-$10^4$ |
| Atomic Emission Flame Spectrometry | $10^0$-$10^6$ |
| Atomic Absorption Spectrometry | $10^{-1}$-$10^5$ (flames)<br>$10^{-5}$-$10^1$ (furnaces) |
| Atomic Fluorescence Spectrometry | $10^{-2}$-$10^4$ (flames)<br>$10^{-6}$-$10^1$ (furnaces) |
| Neutron Activation Analysis | $10^{-2}$-$10^2$ |
| X-ray Fluorescence | $10^3$-$10^5$ |
| Spark Source Mass Spectrometry | $10^{-2}$-$10^2$ |
| Molecular UV-Visible Absorption Spectrometry | $10^1$-$10^4$ |
| Molecular Fluorescence Spectrometry | $10^0$-$10^3$ |
| Differential Pulsed Anodic Stripping Voltammetry (hanging mercury drop) | $10^{-1}$-$10^0$ (ppb, not absolute) |

The absolute limit of detection, ng, is defined as the smallest amount of an analyte that can be measured with a certain confidence.

Table II is taken from "Trace Analysis: Spectroscopic Methods for Elements". Edited by J. W. Winefordner, Wiley-Interscience (1976).

Expressed as wt ppm, the relative limit of detection of metals of atomic emission spark spectrometry is approximately $10^1$ to $10^3$ wt ppm.

Unfortunately, all of these methods still require either relatively large amounts of starting tracer material, or the use of exotic detection methods in the case of radioactive materials. In addition, free metals are often adsorbed by the reservoir matrix. It would be very beneficial if a way could be found to trace the flow of fluids which would provide sensitivity approximating that of radioactive tracer systems, with a non-radioactive material.

SUMMARY OF THE INVENTION

The present invention provides a method of detecting the presence of a tracer in a material comprising contacting the material with a metal chelate, collecting a sample of said material containing said tracer, and analyzing for said tracer material using liquid chromatography.

In another embodiment, the present invention provides a method for tracing the flow of fluid contained in an underground reservoir which comprises injecting into said reservoir a metal chelate with an overall negative or neutral charge as a tracer, removing a fluid sample from said reservoir, and analyzing said sample by liquid chromatography for the presence of said tracer.

In yet another embodiment, the present invention provides a method for tracing the flow of fluid contained in an underground reservoir which comprises injecting into the reservoir a water soluble metal chelate tracer derived from an aryl substituted EDTA, removing a fluid sample from said reservoir after injection of said tracer, subjecting at least a portion of said sample to liquid chromatography to obtain a chromatographic species, reacting the chromatographic species with a fluorogenic agent, and subjecting the reaction product to fluoresence spectroscopy to detect said tracer.

DETAILED DESCRIPTION

My system of metal tracers is very sensitive because it combines two powerful techniques. Modern liquid chromatography, hereinafter referred to as LC, concentrates and separates the metal chelates. The chelate which is used contains or reacts with a fluorogenic agent, such as fluorescamine or o-phthalaldehyde, which permits detection of the chelate by fluorescence spectroscopy.

The preparation of the preferred tracer materials, and the preferred analysis method, are disclosed in my Ph D thesis "Synthesis and Preliminary Evaluation of some EDTA-Type Chelating Agents for Use in Trace Metal Analysis by Liquid Chromatography", University of Wyoming, Laramie, Wyoming, May, 1978, the teachings of which are incorporated herein by reference.

Some other work has been reported relating to chelating agents, see U.S. Pat. No. 3,994,966, Class 260/518R, the teachings of which are incorporated by reference. This chelating agent was to be used with a radioactive label, a radioactive metal ion.

Although these tracer materials, or closely related compounds, are known, there has been no use of the non-radioactive materials as liquid tracers in general or in underground reservoirs in particular. This may be due in part to earlier work which indicated that EDTA was not a suitable tracer material.

The exact form of tracer material used can be determined based on the nature of the fluid to be traced. For use in reservoir tracing, any stable, water soluble metal chelates with an overall negative or neutral charge may be used. An EDTA chelate is preferred because of stability and other reasons. Other chelates which may be used include acetonylacetonates, B-diketonates, compounds closely related to EDTA such as nitrilotriacetic acid and (1,2 cyclohexylenedinitrilo) tetraacetic acid. Different metals can be chelated. Different substituents or ligands can be chosen to increase the detectability of the chelate form, or for other reasons. The types of ligands which may be added, and their effects, are as follows:

| | |
|---|---|
| 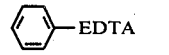 | Allows detection by ultraviolet spectrometry. |
| 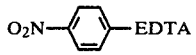 | Increases detectability by ultraviolet spectrometry. |
| 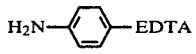 | Allows detection by fluorescence spectroscopy following derivatization with fluorogenic agents. |

Any metal chelates which can be separated by liquid chromatography and detected by potential liquid chromatographic detectors (ultraviolet, visible, and fluorescence spectroscopy; electrochemical; infrared; mass spectroscopic; flame ionization; radioactivity or refractive index) may be used.

Preferred chelates are obtained from the following compounds:

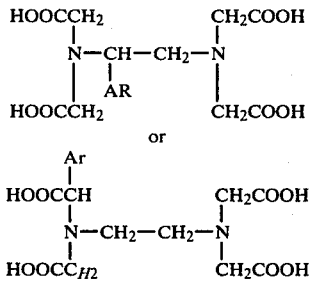

Where Ar=Aryl or other group for use as a detection device.

Especially preferred are the following compounds:

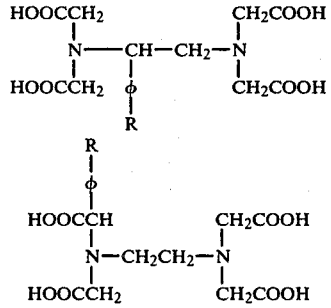

where

R=H
$NO_2$
$NH_2$

The ligands chosen should have high formation constants. This will improve the chemical stability of the tracer, and minimize adsorption of the tracer on reservoir structures. Preferred ligands are EDTA and various substituted EDTA compounds, acetonylacetonates, and B-ketoamines. Acceptable ligands include acetonylacetonates, B-diketonates, compounds closely related to EDTA such as nitrilotriacetic acid and (1,2 cyclohexlenedinitrilo) tetraacetic acid.

The metal ion also serves to increase the stability of the tracer material, but the effect of metal ion chosen is not as great as that of the fluorescing ligand. Preferred metals are lead, cadmium, and zinc. Lead is a particularly good metal for use in the present invention because it is extremely stable and easily detectable. Usually, the tracer will be formed before injection into the well, but in situ formation is also possible, e.g., by injecting large amounts of lead nitrate, and then injecting the chelating agent to form the lead chelate.

The amount of tracing material injected into an underground reservoir is subject to much variation. It depends, e.g., on the particular metal chelate chosen. In general, one gram mole of tracer material for each one million barrels of liquid fluid in the reservoir is needed. If additional steps to concentrate the sample were made, even less tracer would be needed.

Fluids produced are subjected to conventional liquid chromatography to prepare them for further analysis.

The metal chelates which are soluble in water may be used in other systems, e.g., as a way of tracing any substance added to water. This could range from soft drink syrup to fluoride added to water supplies. In other applications, water soluble metal chelating compounds could be added, in dry form, to dry substances such as fertilizer, permitting tracing of fertilizer run-off. The tracer system of my invention may also be used to tag toxic wastes permitting tracing in the case of inadvertent or illegal disposal thereof.

Other uses of my tracing system include the addition of the tracers to encapsulated materials designed for sustained release of compounds in order to follow said release.

As applied to fluid flow tracing in reservoirs, the best mode contemplated by me for practicing the invention will now be described:

The metal chelate(s) of choice are prepared after evaluating possible interferences, background contaminates and adsorption in the reservoir system. The chelate(s) are dissolved in a minimum guantity of water which contains an excess of the metal ion(s) used in the chelate(s) (an excess of $10^3$ times the chelate concentration should suffice). This solution of metal chelate(s) is injected into a flowing injection stream in a manner which allows as little dilution and diffusion as possible. The appropriate outlets (e.g., producing wells) are sampled periodically over a time period commensurate with the anticipated arrival time of the tracer. A sample of five milliliters would be expected to be sufficient at each time interval. The collected samples are analyzed without further preparation.

Produced fluids would be separated into water and oil phases, if any. The water phase would be subjected to liquid chromatography followed by fluorescence or other appropriate detection.

A good laboratory instrument for liquid chromatography is the Waters Associates Model ALC204 Liquid Chromatography equipped with a Model 660 programmer and a Model U6-K injector. A Model 440 ultraviolet detector with 254 mm detection was used. Fluorescence detection was on an Aminco Fluoromonitor equipped with the standard filters for Fluorescamine detection. The Fluorescamine solution was pumped using an ISCO Model 314 pump and controller. The reverse phase column was a Waters Associates (micro) $\mu$-Bondapak C. $C_{18}$. The ion exchange column was a Whatman Partisil SAX (both 250 mm$\times$4.6 mm ID). Since the reverse phase column concentrates trace organic impurities from water it was necessary to keep any water used in the LC process as free from contaminates as possible. This required distilled water, stored in glass containers, as opposed to plastic bottles.

Fluorescence spectra of the metal chelate tracers were obtained as follows: A standard solution of known concentration was tested, and the sample compared to the known. A further check, of the system was run using distilled water.

Further details of the liquid chromatography separation and generation of fluorescence spectra are given in my thesis, and further discussion herein is not believed necessary.

The tracer system of the present invention works well because the tracers are concentrated by liquid chromatography, and then analyzed by fluorescence spectroscopy which is inherently very sensitive. LC, in concentrating the tracers, reduces the sample size drastically, but fluorescence spectroscopy works well with minute amounts of material. A typical sample from a well would contain 5 ml. The amount of material charged to the LC apparatus is 100 microliters.

In a typical chemical flooding oil recovery program, micellar solution is injected into a well, after which a polymer solution is injected, followed by a water drive. Optionally a preflood may be used before the micellar solution is injected. Using my invention it will be possible to add the tracer to any of the aqueous solutions. A tracer would not be added routinely to all aqueous solution, though the ease of use of my invention readily permits this if someone wants to do so.

Before getting into the details of the practice of my invention, a brief discussion will be made of a prior art tracing method, addition of methyl alcohol to a polymer flood. This prior art tracing method was actually performed as a part of the El Dorado micellar-polymer demonstration project, in cooperation with the Department of Energy under contract #ET-78-C-03-1800. 2.0% methyl alcohol was added as a tracer. The concentration was limited by the tolerance of the polymer solution for alcohol. It would be desirable to add pure tracer, but the polymer solution would only tolerate 2.0%. The amount of tracer was fixed by the sensitivity of the analytical method, conventional gas chromatography. In this particular pattern, wherein about 250,000 barrels of fluid would be contacted, it was necessary to add 76 barrels of alcohol. This material was relatively expensive, had to be added over several days, presented a safey hazard because it was flammable, and was toxic.

In contrast, in practicing the present invention it would only be necessary to add about 0.25 gram mole of a substituted lead EDTA. This material can be formed by reacting a substituted EDTA, with any of the water soluble lead compounds, such as lead nitrate. One gram mole of the substituted lead EDTA weighs approximately 600 grams, so about 150 grams is required. This material would dissolve in about 2.5 l of water, but to ensure that all of the material dissolves 10 l should be used, or for convenience one barrel (42 gallons) of water could be used. This amount of material can be readily injected either as a single slug, or it may be introduced along with part of the polymer flood via a small chemical injection pump, connected to the suction or the discharge side of the polymer injection pump.

Produced fluids would be separated, using conventional means, into water and hydrocarbon phases, and the water tested for the presence of the substituted lead EDTA using the Waters chromatograph, and associated equipment, as previously discussed.

It can be seen that the practice of the present invention provides an inexpensive, safe, but extremely effective means of tracing fluid flow in an underground reservoir, or tracing any other water soluble material.

I claim:

1. A method of detecting the presence of a tracer in a material comprising contacting the material with metal chelate tracer formed by the reaction of an aryl substituted ethylenediaminetetraacetic acid and a metal ion selected from the group consisting of lead, cadmium and zinc, collecting a sample of said material containing said tracer, passing said sample through a liquid chromatographic column to obtain said tracer, reacting said separated tracer with a fluorogenic reagent and detecting the reaction product of said separated tracer and said fluorogenic reagent by fluorescent or ultraviolet spectroscopy.

2. Method of claim 1 wherein the aryl substituted ethylenediaminetetraacetic acid comprises

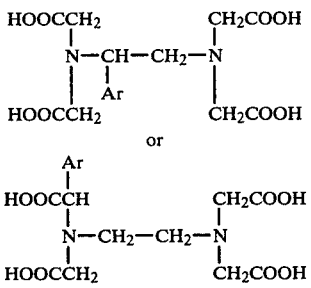

where Ar is Aryl.

3. Method of claim 1 wherein the aryl substituted ethylenediaminetetraacetic acid comprises

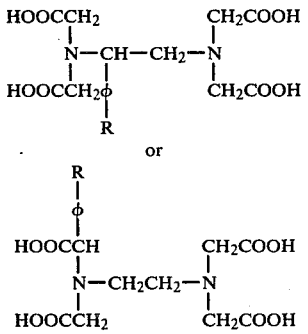

-continued where R=H
$NO_2$
$NH_2$

4. Method of claim 1 wherein the fluorogenic agent is fluorescamine or o-phthalaldehyde.

5. Method of claim 1 wherein the material to be traced comprises water.

6. Method of claim 1 wherein the material to be traced comprises a water soluble solid.

7. A method for tracing the flow of fluid contained in an underground reservoir which comprises injecting into said reservoir a metal chelate with an overall negative or neutral charge as a tracer, removing a fluid sample from said reservoir, and passing said sample through a liquid chromatographic column to obtain said tracer, reacting said separated tracer with a fluorogenic reagent and detecting the reaction product of said separated tracer and said fluorogenic reagent by fluorescent or ultraviolet spectroscopy and wherein the chelate tracer is formed by the reaction of an aryl substituted ethylenediaminetetraacetic acid or derivative thereof and a metal ion from the group consisting of lead, cadmium and zinc.

8. Method of claim 7 wherein the tracer is injected into the reservoir as a water solution.

9. Method of claim 7 wherein the reservoir contains liquid petroleum, a drive fluid comprising water is pumped into the reservoir through an injection well to drive petroleum to a producing well and wherein the tracer is added to at least a portion of the drive fluid.

10. A method for tracing the flow of fluid contained in an underground reservoir which comprises injecting into the reservoir a water-soluble metal chelate tracer formed by the reaction of an ethylenediaminetetraacetic acid with an aryl substituent and a metal selected from the group consisting of lead, cadmium, and zinc, removing a fluid sample from said reservoir after injection of said tracer, passing said sample through a liquid chromatographic column to obtain said tracer, reacting said separated tracer with a fluorogenic reagent and detecting the reaction product of said separated tracer and said fluorogenic reagent by fluorescent or ultraviolet spectroscopy.

11. Method of claim 10 wherein the metal is lead and the fluorogenic agent is fluorescamine.

* * * * *